US009425011B2

(12) United States Patent
Creighton et al.

(10) Patent No.: US 9,425,011 B2
(45) Date of Patent: Aug. 23, 2016

(54) METHOD AND SYSTEM FOR SOFT SWITCHING OF A RELAY

(71) Applicant: General Electric Company, Schenectady, NY (US)

(72) Inventors: Jason Creighton, Twinsburg, OH (US); David Christopher Shilling, Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 154 days.

(21) Appl. No.: 13/975,430

(22) Filed: Aug. 26, 2013

(65) Prior Publication Data

US 2015/0055272 A1 Feb. 26, 2015

(51) Int. Cl.
*H01H 47/02* (2006.01)
*H01H 47/00* (2006.01)
*H01H 9/56* (2006.01)

(52) U.S. Cl.
CPC ..... *H01H 47/002* (2013.01); *H01H 9/56* (2013.01); *H01H 2047/009* (2013.01)

(58) Field of Classification Search
CPC ..... H02J 17/00; H01H 47/18
USPC ..... 361/195, 160, 42, 142
See application file for complete search history.

(56) References Cited

U.S. PATENT DOCUMENTS 4,051,394 A 9/1977 Tieden
4,670,810 A 6/1987 Valeur
4,864,157 A 9/1989 Dickey
4,922,363 A * 5/1990 Long et al. ..... 361/3
5,064,998 A 11/1991 Holling
5,267,120 A 11/1993 Graff et al.
5,359,486 A * 10/1994 Crane et al. ..... 361/3
5,416,404 A 5/1995 Baldwin
5,452,177 A * 9/1995 Frutiger ..... H01L 21/36831 279/128
5,473,202 A 12/1995 Mudge et al.
5,530,615 A * 6/1996 Miller ..... H01H 9/56 307/141
5,640,113 A 6/1997 Hu
5,804,991 A 9/1998 Hu
5,821,642 A 10/1998 Nishhira et al.
5,838,077 A 11/1998 Chelcun et al.
6,233,132 B1 * 5/2001 Jenski ..... H01H 9/56 361/152
6,472,877 B1 * 10/2002 Sands ..... 324/423
6,768,615 B2 * 7/2004 Liu ..... H01H 9/56 361/160
7,057,311 B1 * 6/2006 Zhou ..... H01H 9/563 307/126
7,227,732 B2 6/2007 Wang
7,672,096 B2 3/2010 Messersmith et al.
7,683,755 B2 * 3/2010 Ostrovsky ..... G05B 15/02 315/295
8,324,761 B2 * 12/2012 Elliott ..... H05B 37/0254 307/125
8,436,541 B2 * 5/2013 Olson ..... H05B 37/0227 315/149
8,467,164 B2 * 6/2013 Elwell ..... H01H 47/02 307/131
8,736,193 B2 * 5/2014 Gallo ..... H05B 33/0815 315/291

(Continued)

*Primary Examiner* — Thienvu Tran
*Assistant Examiner* — Angela Brooks
(74) *Attorney, Agent, or Firm* — GE Global Patent Operation; Peter T. DiMauro

(57) ABSTRACT

Provided is a system for soft switching of an electromechanical relay in a lighting control system using a sensor to detect a specified non-zero position in the electrical input waveform. Following this non-zero position, an adaptive time delay is applied before activation of the relay coil. An error detection circuit measures a time error between relay operation and the zero electrical input condition. This error signal is used to update the adaptive time delay for future relay operations. Using such a procedure has been shown to limit electrical stress on the relay, and therefore lengthen its life.

12 Claims, 4 Drawing Sheets

(56) References Cited

U.S. PATENT DOCUMENTS

2006/0274459 A1* 12/2006 Zhou ..... H01H 50/546
361/23
2013/0308356 A1* 11/2013 Subramanium ..... H02J 5/00
363/53
2014/0009856 A1* 1/2014 Ward ..... H02H 3/162
361/42
2016/0133413 A1* 5/2016 Bock ..... H01H 33/08
361/142

* cited by examiner

METHOD AND SYSTEM FOR SOFT SWITCHING OF A RELAY

FIELD OF INVENTION

The present invention is related to the use of soft switching in a lighting control device in order to improve the useful electrical life of the relay.

BACKGROUND OF THE INVENTION

Most lighting control devices and systems incorporate electromechanical relays (hereinafter relays), as the means for switching lighting loads to the "on" or "off" positions. Electromechanical relays are typically comprised of a set of electrical contacts which can be alternately connected or disconnected by applying an electrical signal to an electrically isolated coil.

Using a relay for switching provides several advantages. Since the contacts of the relay are physically separated by an air gap when open, the relay allows no leakage current when open, increasing efficiency and safety. In addition, since the relay coil is electrically isolated from the contacts, the relay drive circuit can be isolated from the electrical system being switched. Finally, relays are capable of switching heavy loads without the use of heat sinking, unlike semiconductor switches.

The main disadvantage of relay switches are the limited operational life compared to their semiconductor counterparts. A latching relay typical to lighting control devices may be rated for 50,000,000 mechanical operations under no load, but may have a typical life rating of only 100,000 operations under an electrical load. The decrease is due to factors such as an electrical arc developing between the contacts when under high voltage, which causes damage. As the relay attempts to open a high-current inductive load, the tendency to arc is increased. As the relay attempts to connect a capacitive load to high voltage, an inrush current develops that can weld the contacts together. Under the high inrush-current situations typically seen in lighting applications, the practical relay life can be much lower than the specified rated value.

Therefore, it is essential that the electrical stress on the relay be limited during switching. When the voltage applied to the relay contact is an alternating current (AC) voltage, as in many lighting systems, the electrical stress on the relay can be effectively limited by choosing an optimal moment in the AC waveform during which the relay contacts open or close. This technique is known as soft switching.

In soft switching, the relay is selectively operated such that the contact closures occur at a point in the AC cycle such that electrical voltage or current stress is at a minimum, i.e., zero. This idea can be challenging in practice, due to factors such as relay delay time from the time the relay coil is activated to when the relay contact is switched. The relay delay time may vary from part to part, over the lifetime of the relay, and according to the electrical conditions on the relay. Therefore a robust soft switching strategy must account for this relay delay in order to maximize relay life.

Many attempts at relay soft switching have been attempted. U.S. Pat. No. 5,267,120 utilizes a specialized approach includes the presence of a high-frequency carrier single injected into the AC system for communication. While the soft switching methods shown are reasonable, the presence of the high-frequency carrier is unnecessary in most applications.

Several approaches, specifically U.S. Pat. Nos. 5,473,202 and 7,672,096 place a longer-life semiconductor switch in parallel with the relay in order to bear the electrical stress. This approach presents higher cost and negates many of the isolation benefits of using a relay at all.

U.S. Pat. No. 7,227,732 measures the operation time of the relay in order to determine the correct activation timing. The use of a pre-measured relay operation time is inefficient due to the fact that relay operation times vary depending on the type of relay and the operating conditions, thus a consistent approach cannot be utilized.

Finally, there are a variety of approaches (U.S. Pat. Nos. 5,359,486; 5,416,404; 5,640,113; 5,804,991; 5,821,642; 5,838,077; 6,768,615) which start their timing operations from a position of zero-crossing of the AC voltage or current signal in order to operate the relay at a subsequent zero-crossing.

Each of the aforementioned patents based their software algorithm on a zero-crossing detection of the AC waveform. The soft switch is achieved by applying either an adaptive or fixed time delay from detected zero-crossing. However, the aforementioned patents do not use a non-zero position detection in conjunction with adaptive timing to operate a soft switching system.

SUMMARY OF EMBODIMENTS OF THE INVENTION

Given the aforementioned deficiencies, a need exists for a software switching system which accounts for a relay delay time and may be adjusted to configure with multiple parts. To resolve the problems mentioned above, an object of the present invention is to provide an adaptive timing process that is applied from a fixed non-zero position on an electrical input waveform.

In one embodiment, a method for achieving soft switching in a relay is provided. The method includes monitoring an input power source that is intended to be applied to or removed from a load, detecting a specified non-zero position of the input power source waveform, switching a relay contact a specified delay time after the detection of the non-zero position, creating an error reading by switching the relay contact and comparing the presence of the input power source between a relay control and the relay contact, and applying an adaptive timing process to adjust the specified delay time until the error reading substantially approaches zero.

The embodiments provide a low power, cost-effective soft switching system. Latching relays may be utilized in the switching system as a way to reduce power consumption, as no power is used once a latching relay is connected.

In another illustrious embodiment, a voltage detector can be used as an error detector to reduce cost, depending on the placement of the voltage detector within the switching system. By monitoring the presence or absence of voltage at the load terminal of the relay contact, the amount of error in the soft switching method can be determined. Also, the use of the soft switching is coordinated for use in countries with varying electric outlet and voltage standards.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

DETAILED DESCRIPTION OF THE PREFERRED EMBODIMENTS

While the present invention is described herein with illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

Figure 1:
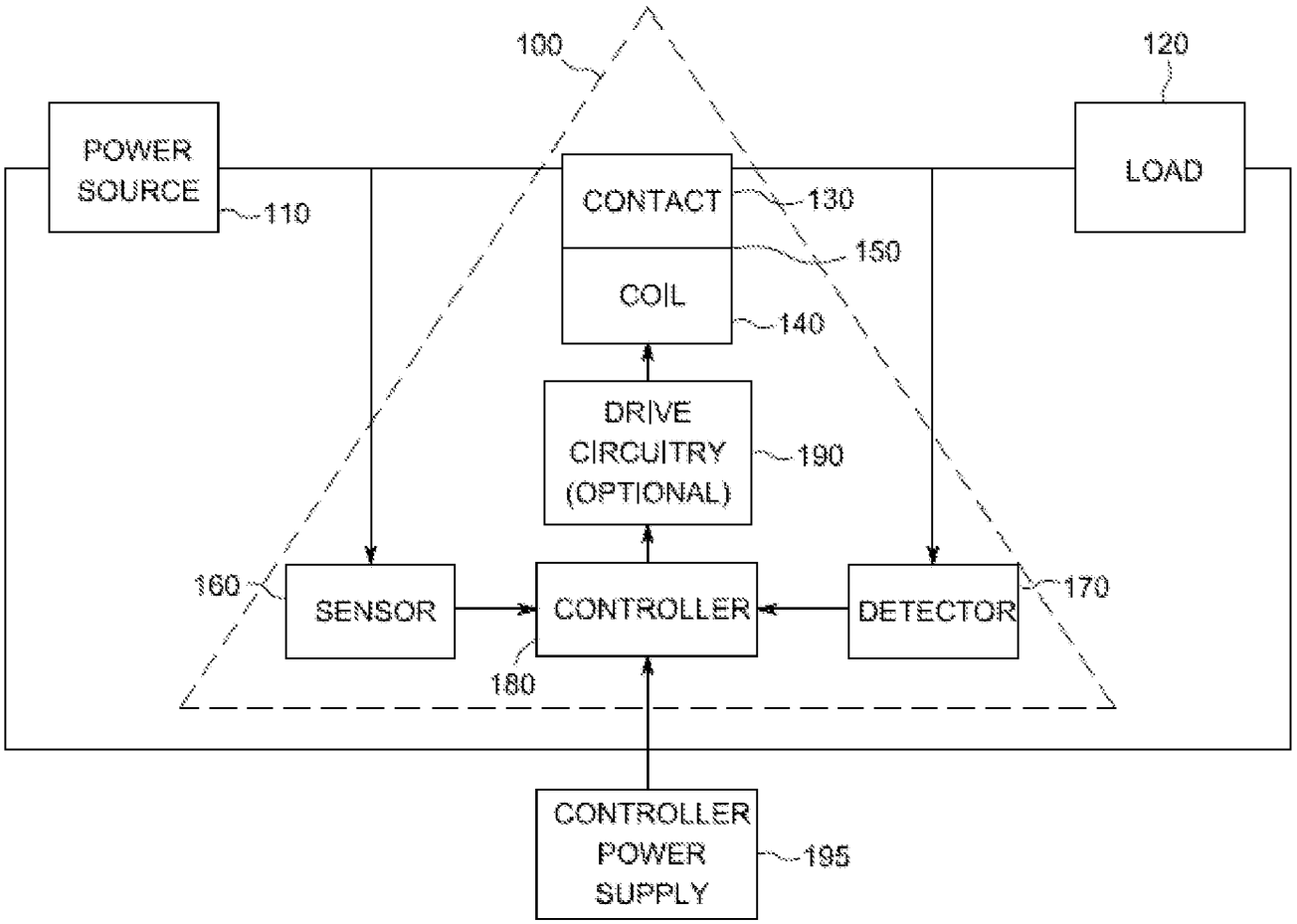
FIG. 1 is a block diagram illustration of an exemplary switching system constructed and arranged in accordance with an embodiment of the present invention.

As used in this application, the terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. FIG. 1 is an illustration of a switching system 100 coupled to a power source 110, with the power source 110 being applied to load 120 prior to a relay contact 130 being closed.

In a lighting system, the power source 110 will typically be a sinusoidal AC power source, but may be any known power source where it is possible to distinguish a fixed non-zero point on the power source waveform, such as a square-wave inverter power source, or the like. The power source 110 has a neutral connection, which need not be supplied to the switching system 100, only to load 120. The switching system 100 may include relay 150, sensor 160, error detector 170, controller 180, and a drive circuit 190.

The switching system 100 is desirably activated to supply the power source 110 to the load device 120 once the relay 150 is closed. The relay 150 includes a contact 130 and a relay coil 140 and becomes operational when the coil 140 is energized according to its specifications, where it activates and closes or opens the contact 130. The contact 130 and the coil 140 may be part of a latching relay to reduce the power consumption of the system, since the coil 140 consumes power only while it is being switched, and the relay contact 130 would retain this setting across a power outage. However, if the coil 140 requires more power than can be given by the controller 180, the drive circuit 190 may be used.

The sensor 160 is configured to detect a specified non-zero position on the waveform of the power source 110. The sensor 160 may be implemented in hardware, or a combination of hardware and software. The sensor 160 may be located between the power source 110 and the relay 150, and the sensor 160 may have continuous information about the waveform of power source 110.

When the sensor 160 detects a specified non-zero position on waveform of the power source 110, the occurrence is communicated to the controller 180 which activates the digital logic and adaptive timing process. The specified non-zero position may be at any point on an electrical input waveform, including a maximum or a minimum value. The non-zero position is communicated from the sensor to the controller 180 as an input, which triggers the use of the adaptive timing program logic of the controller 180.

The system 100 can also optionally include the detector 170, which indicates to the controller 180 when either voltage, current, or power is detected on the line, based on its location and construction. In the exemplary switching system 100, the detector 170 is positioned between the load 120 and the relay contact 130, as seen in FIG. 1. In this position, the detector 170 has access to changes to the load-terminal voltage caused by switching of the relay contact 130. However, the detector 170 may be placed at a different location within the switching system 100 or with different construction such that the detector 170 can measure the presence or intensity of information such as voltage, power, current, resistance, etc. at the load-terminal of the relay 150.

In one embodiment, the detector 170 by nature of its construction is able to detect an error on one side of the soft switching point. For example, the detector 170 may only be able to detect an error if the relay contact 130 closes after the intending soft switching point, but not before. In another example, the detector 170 may only be able to detect an error if the contact 130 opens prior to the intended soft switching point, but not after.

In the embodiments, the controller 180 performs the digital logic and adaptive timing process with input from the detector 170. When the specified non-zero position on the power source 110 waveform is detected by the sensor 160 and communicated, the controller 180 waits for a specified time delay prior to activating the coil 140. The controller 180 may have an internal power source. However, depending on the complexity of the programming of the controller 180, it may be necessary for the controller 180 to have its own power source 195.

The specified time delay may be based on a combination of digital logic, adaptive timing, or the like. The controller 180 may be programmed to detect a specified non-zero position on the electrical input waveform of the power source 110, from which point the controller 180 may be programmed with a specified delay time based before it closes or opens the relay 150. Once the relay 150 is closed or opened, the detector 170 searches for an energy change in the load indicating a deviation from ideal soft switching performance (i.e., an error). The controller 180 may also have at least one hardware timer for an internal clock, which may control the adaptive timing process.

In the embodiment, the detector 170 searches for the specified delay time between the switching of the relay contact 130 and the ideal switching point, which is the zero-voltage point of the power source 110. In another embodiment, the zero-current or zero-power point of the power source 110 can be used as the ideal switching point. The ideal point chosen for switching of the relay contacts, whether zero-voltage, zero-current, zero-power, or the like, is hereafter referred to as the soft switching point. If such error exists, the controller 180 adjusts its time delay for future use, until no error occurs.

In another embodiment, the detector 170 by nature of its construction is only able to detect an error on one side of the soft switching point. For example, the detector 170 may only be able to detect an error if the relay contacts 130 close after the intending soft switching point, but not before. In another example, the detector 170 may only be able to detect an error if the contacts 130 open prior to the intended soft switching point, but not after.

The adaptive timing process is used to operate the relay so as to limit the electrical stress on the relay contacts. In this embodiment, the adaptive timing process can be adjusted to account for the operation of detector 170. If an error is detected, the controller 180 adjusts its delay time for future use. However, if no error is detected, the controller 180 adjusts its specified delay time incrementally to account for potential error it is not able to detect.

This adjustment occurs at least once, but may continue through multiple iterations. Eventually, the delay time will have been adjusted to a point that creates a detectable error, which will be corrected for as previously described. In one embodiment, the incremental adjustment can be a decrease in time delay; however, it should be understood by one of skill in the art that an incremental adjustment can be an increase in the time delay, depending on the switching system 100 configuration.

The controller 180 may be a microcontroller, microprocessor, programmable logic controller (PLC), complex programmable logic device (CPLD), field-programmable gate array (FPGA), or the like. The controller 180 may be use code libraries, static analysis tools, software, hardware, firmware, or the like. Any use of hardware or firmware includes a degree of flexibility and high-performance available from an FPGA, combining the benefits of single-purpose and general-purpose systems. After reading this description, it will become apparent to a person skilled in the relevant art how to implement the invention using other computer systems and/or computer architectures.

Various embodiments of the controller 180. The may be simulated, synthesized and/or manufactured can be accomplished, in part, through the use of computer readable code, including general programming languages (such as C or C++), hardware description languages (HDL) including Verilog HDL, VHDL, Altera HDL (AHDL), interactive languages, and the like, or other available programming and/or schematic capture tools (such as circuit capture tools).

User programming of the controller 180 using FPGA may be completed through the use of approved external tools (either from an FPGA vendor or from a third party tool vendor), well known to those of skill in the art, to create a downloadable configuration file. The configuration file can then be imported into the PLC programming tool and associated with a specific task required to be performed by the configurable hardware.

Additional input/output systems (I/O systems) may also be used to receive information from and provide information to controller 180. These I/O systems and firmware may include but are not limited to relay drive outputs per relay, indicator outputs, and logic outputs.

Figure 2:
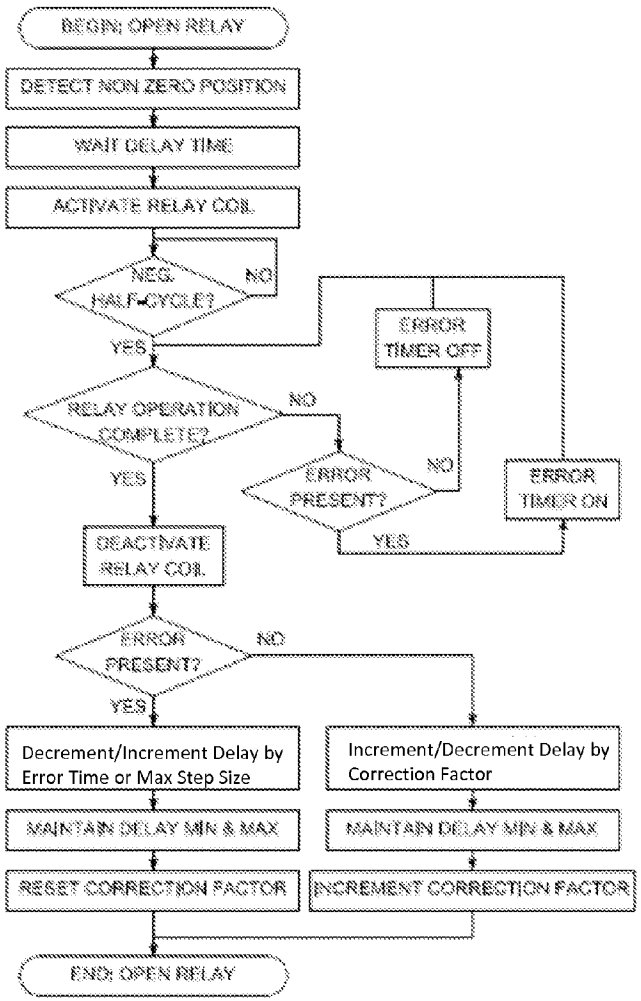
FIG. 2 is a flow chart of an exemplary method of practicing an embodiment of the present invention.

FIG. 2 is a flowchart of an exemplary method of practicing an embodiment of the present invention. As depicted in FIG. 2, once the controller 180 detects an error, a delay time quantum specified in the controller creates a step size. That step size can be predetermined or also adapted according to its use within the switching system or for varying electricity regulations.

For example, when opening the contacts, the delay time quantum can incrementally increased until an error is detected, at which point the delay time quantum is decreased by the amount necessary to remove the error. When closing the contacts, a mirror-image process can be used in which the delay time quantum is incrementally decreased until an error is detected, at which point the delay time quantum is increased by the amount necessary to remove the error. Once a step size is established, there may be a tolerance to allow a maximum or minimum step size to be performed by the controller.

The tolerance may be preset within the program code or may be adjusted based on other input conditions such as energy input. In addition to the step size, it may be desirable to include a correction factor within controller 80 program code. The correction factor allows adjustments to be made based on differences in power supplies, and may be preset or adjustable within controller 80 program code.

Figure 3A:
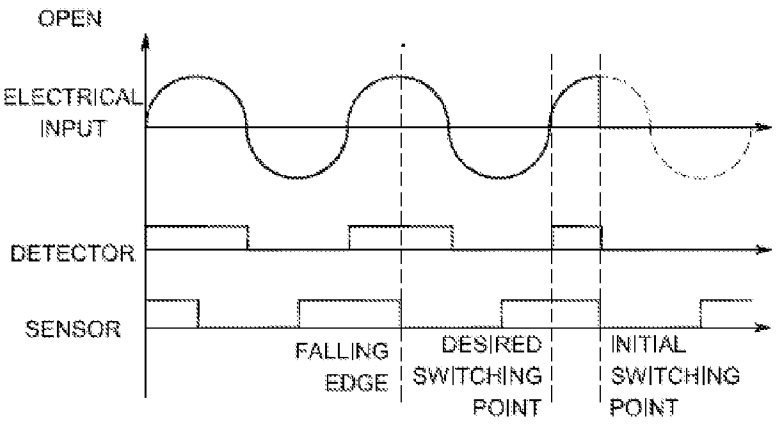
FIG. 3A is an illustration of a first exemplary timing diagram related to one aspect of the switching system, in accordance with the embodiments.
Figure 3B:
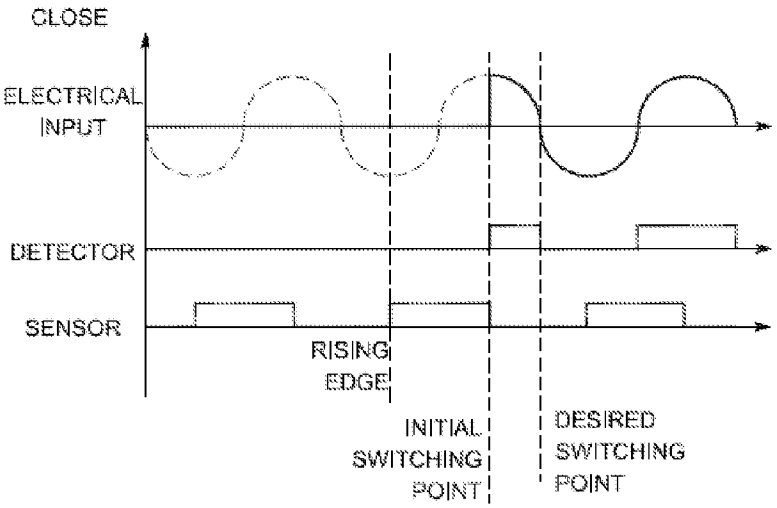
FIG. 3B is an illustration of a second exemplary timing diagram related to another aspect of the switching system.

FIGS. 3A and 3B is an illustration depicting a relationship between the electrical input from the power source 110, the sensor 160, and the detector 170. More specifically, FIG. 3A depicts how an error occurs when the switch time delay is too late. Conversely, FIG. 3B depicts how an error occurs when the switch time delay is too early. In both figures, there is an initial switching point, which is the position from which the adaptive timing begins. The timing is adjusted based on whether the goal of the switching system 100 is to open or close the circuit.

Figure 4:
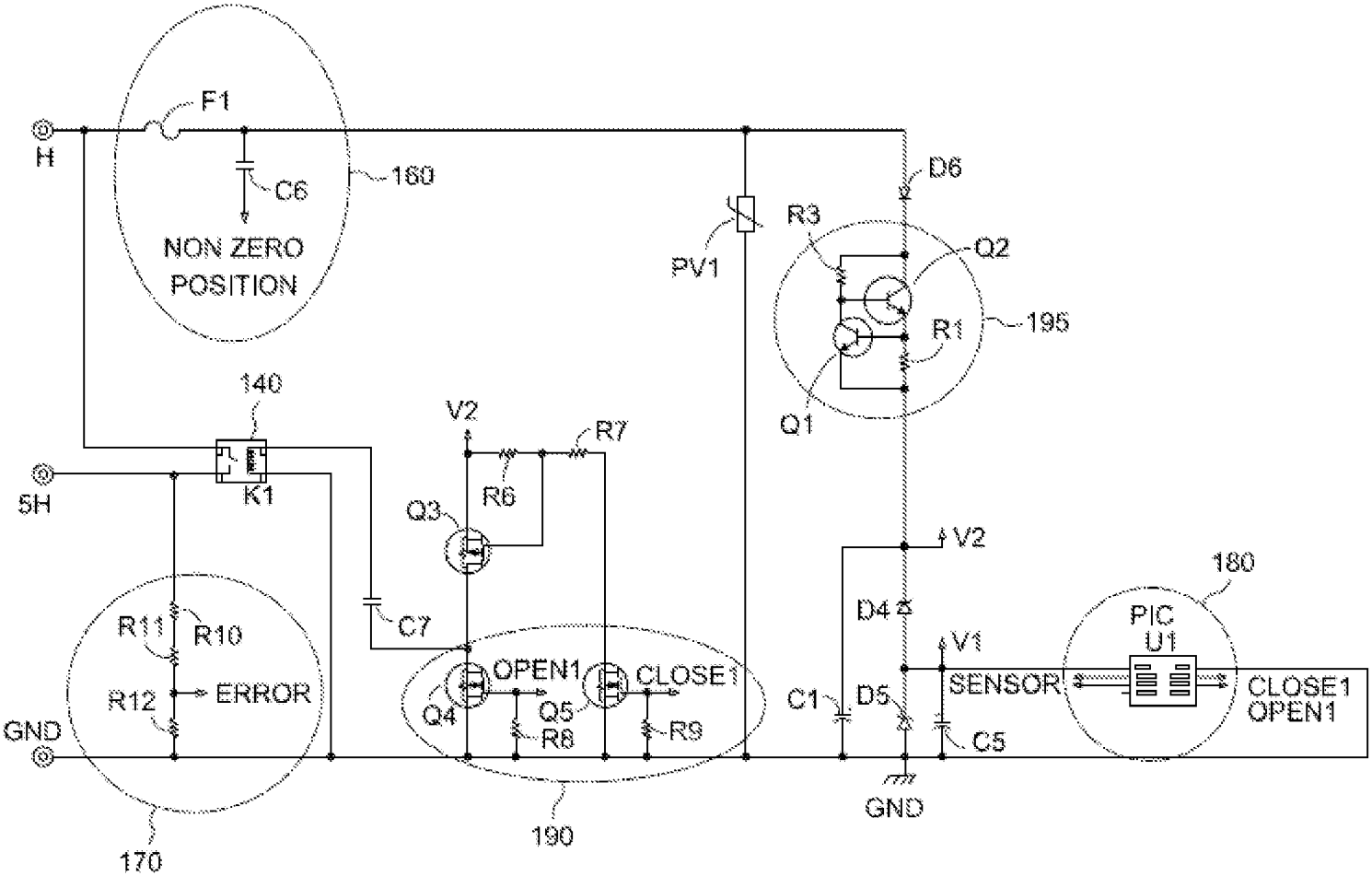
FIG. 4 is an illustration of an exemplary switching system circuit constructed in accordance with the embodiments.

FIG. 4 is an illustration of one implementation of a switching system circuit 100 according to the embodiments. It should be noted that the FIG. 4 is for purposes of illustration only. The present invention, however, is not limited to the implementation illustrated in FIG. 4. One or skill in the art would recognize other implementations that are comparable to receive the desired results of adaptive timing are within the spirit and scope of the present invention.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What we claim is:

1. A method for controlling a switching system configured to provide power from an alternating current (AC) power source to a load based upon operation of a relay, comprising:

sensing, via a sensor disposed between the AC power source and the relay, a specifiable non-zero value of an AC waveform output from the power source;

receiving, via a switching system controller, the non-zero value sensed and activating the relay at an actual switching time after a specified time delay;

detecting, via a detector disposed between the relay and the load, changes to the voltage at the load caused by switching of the relay, searching for the specified time delay between the actual switching time and the ideal switching time which is a zero-voltage point of the AC power source; and determining a difference between the actual switching time and an ideal switching time based upon power at the load, the difference being representative of an error factor;

wherein the controller adjusts the specified time delay in response to the error factor during future relay operation.

2. The method of claim 1, wherein the non-zero position can be a positive or negative electrical input maximum; and wherein the applying is in accordance with soft switching principles.

3. The method of claim 1, wherein the error factor is created by adjusting the delay time quantum.

4. The method of claim 3, wherein the adaptive timing process adjusts the delay time quantum incrementally until the error factor substantially approaches zero.

5. The method of claim 1, wherein the adjusting occurs incrementally until the error factor substantially approaches zero.

6. A switching system configured to provide power from an alternating current (AC) power source to a load based upon operation of a relay, the switching system comprising:

a sensor disposed between the AC power source and the relay and configured to sense a specifiable non-zero value of an AC waveform output from the AC power source;

a controller configured to (i) receive the non-zero value sensed and (ii) activate the relay at an actual switching time after a specified time delay; and a detector disposed between the relay and the load and configured to (i) detect changes to the voltage at the load caused by switching of the relay, (ii) search for the specified time delay between the actual switching time and the ideal switching time which is a zero-voltage point of the AC power source, and (iii) detect a difference between the actual switching time and an ideal switching time based upon power at the load, the difference being representative of an error factor;

wherein the controller adjusts the specified time delay in response to the error factor during future relay operation.

7. The system of claim 6, wherein the position can be any specified non-zero point on the on the electrical input.

8. The system of claim 6, wherein the position can be a positive or negative electrical input maximum.

9. The system of claim 6, wherein the electrical input continuously communicates with the detector.

10. The system of claim 6, wherein the detector identifies at least one from the group including voltage, current, power, and resistance.

11. The system of claim 6, wherein the adjusting occurs incrementally until an error factor substantially approaches zero.

12. The switching system of claim 6, wherein the detector is further configured to detect the error factor only when the relay closes after the ideal switching time, or when the relay opens prior to the ideal switching time.

* * * * *